US006564870B1

(12) United States Patent
Grigsby et al.

(10) Patent No.: US 6,564,870 B1
(45) Date of Patent: May 20, 2003

(54) METHOD AND APPARATUS FOR COMPLETING WELLS WITH EXPANDING PACKERS FOR CASING ANNULUS FORMATION ISOLATION

(75) Inventors: Tommy F. Grigsby, Houma, LA (US); Sanjay Vitthal, Houston, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 232 days.

(21) Appl. No.: 09/666,802

(22) Filed: Sep. 21, 2000

(51) Int. Cl.[7] ..... E21B 43/10
(52) U.S. Cl. ..... 166/313; 166/50; 166/207
(58) Field of Search ..... 166/313, 50, 207, 166/380, 382

(56) References Cited

U.S. PATENT DOCUMENTS

| | | | | |
|---|---|---|---|---|
| 2,812,025 | A | * 11/1957 | Teague et al. | 166/207 |
| 6,318,457 | B1 | * 11/2001 | Den Boer et al. | 166/66.7 |
| 2001/0045284 | A1 | * 11/2001 | Simpson et al. | 166/313 |
| 2001/0045289 | A1 | * 11/2001 | Cook et al. | 166/380 |

* cited by examiner

*Primary Examiner*—William Neuder
(74) *Attorney, Agent, or Firm*—Marlin Smith

(57) ABSTRACT

Expanding packers for use in oil or gas wellbores, with and without casing, for isolating a casing annulus or geologic formation from the remainder of the wellbore and for increasing production flow rates. These expanding packers are useful in completing sidetracked wells.

19 Claims, 5 Drawing Sheets

METHOD AND APPARATUS FOR COMPLETING WELLS WITH EXPANDING PACKERS FOR CASING ANNULUS FORMATION ISOLATION

BACKGROUND OF THE INVENTION

1. Field of the Invention

The present invention relates to apparatus and methods for drilling and/or completing wells in the subterranean. In another aspect, the present invention relates to apparatus and methods for isolating geological formations in wells and isolating well casing annuluses. In even another aspect, the present invention relates to apparatus and methods for producing from side tracked wells drilled from the bore of previously drilled wells. In still another aspect, the present invention relates to apparatus and methods for isolating defective casing in an existing wellbore, isolating a liner top, or isolating a zone.

2. Description of the Related Art

Oil fields are usually produced by drilling wells to one or more large reservoirs or to vertically-separated smaller reservoirs encountered by an individual wellbore. The costs of a well are the costs of drilling and the cost of completion. Whereas drilling is the actual creation of the wellbore, completion is the process of inserting casing, tubing, and tubular accessories into the well to allow the oil or gas to be drawn out and stored for use. It is common practice in completing a well to run a string of protective casing into the wellbore and then to run production tubing inside the casing to one large reservoir or to vertically-separated production zones encountered by the wellbore. Once the oil or gas bearing formations penetrated are depleted, the well has lost its usefulness.

In many instances, small reservoirs in other areas of the oil bearing formation in the vicinity of the wellbores may not be depleted. Unfortunately, it is expensive to drill out through the side of the well (sidetrack) through the existing well casing using conventional sidetracking methods. Such methods require that the tubing be removed, a section of the casing be milled out and a drill run back down through the casing and directed outward through the milled-out section to drill a directional well from the casing outwardly to an area from which additional hydrocarbons may be recovered. Since these techniques are relatively expensive, the amount of potential hydrocarbon recovery required to justify such sidetracking operations is relatively large. Since, in many instances, areas of potentially recoverable hydrocarbons containing less than the amount required to justify this additional expense are known, it is desirable that a more economical method be developed to enable the economical recovery of these smaller quantities of hydrocarbons. The smaller quantities of hydrocarbons may, in fact, be quite sizeable.

One problem that can reduce the cost effectiveness of a side tracked well is that the new tubing inserted in the original well casing in the process of drilling the lateral well usually is of smaller diameter than the tubing of the original well to provide room for passing the tubing down the casing and into the lateral wellbore. This smaller diameter of tubing reduces the rate at which oil or gas can be brought to the surface.

Another problem associated with conventional sidetracking methods is the frequent need to run and cement an additional set of casing above or through the proposed producing formation to isolate the side tracked well from such problems as adjacent water-bearing formations.

There is a need in the art for apparatus and method for drilling and/or completing a well.

There is another need in the art for improved apparatus and methods for drilling and/or completing a well, which do not suffer from all of the deficiencies of the prior art.

There is even another need for apparatus and methods for performing cost-effective side tracked well completions.

There is still another need in the art for apparatus and methods for accessing small reservoirs with side tracked completions, which do not suffer from the disadvantages of the prior art apparatus and methods, such as the need to run and cement an additional set of casing above or through the proposed producing formation.

There is yet another need in the art for apparatus and methods for isolating formations and well casing annuluses.

There is even still another need in the art for apparatus and methods for isolating formations and well casing annuluses which address at least some of the deficiencies of the prior art, such as obtaining reduced flow rates because of the necessity of running smaller tubular strings to operate within existing wells.

These and other needs in the art will become apparent to those of skill in the art upon review of this specification, including its drawings and claims.

SUMMARY OF THE INVENTION

It is an object of the present invention to provide for an improved apparatus and method for drilling and/or completing a well.

It is another object of the present invention to provide for apparatus and methods for performing cost-effective side tracked well completions.

It is even another object of the present invention to provide for apparatus and methods for accessing small reservoirs with side tracked completions, which do not suffer from the disadvantages of the prior art apparatus and methods, such as the need to run and cement an additional set of casing above or through the proposed producing formation. It is an object of the present invention to provide for apparatus and methods for isolating formations and well casing annuluses.

It is still another object of the present invention to provide for apparatus and methods for isolating formations and well casing annuluses which address at least some of the deficiencies of the prior art, such as obtaining reduced flow rates because of the necessity of running smaller tubular strings to operate within existing wells.

These and other objects of the present invention will become apparent to those of skill in the art upon review of this specification, including its drawings and claims.

According to one embodiment of the present invention, there is provided a packer system which generally includes an expandable tubing and at least one elastomeric expanding element encircling said tubing. In a more specific non-limiting embodiment of this embodiment, the expandable packer system includes expandable tubing with separated transverse external bands of elastomeric elements adhering to the tubing with each of the two transverse edges of each band anchored by single centralizer rings, which also serve to maintain a packer in the center of a wellbore or casing.

According to another embodiment of the present invention, there is provided a work string assembly for use in a subterranean wellbore. The assembly generally includes a work string suitable for insertion into the wellbore. The work string also includes a pig launcher connected to the work string. The work string even also includes an expandable tubing connected to the pig launcher and at least one elastomeric expanding element encircling said tubing.

According to even another embodiment of the present invention, there is provided a method for expanding a packer in a well. The method generally includes positioning a packer system, as described above, in a subterranean well, and then passing an expansion pig through the expandable tubing to abut the elastomeric elements against the well wall.

DETAILED DESCRIPTION OF THE INVENTION

Figure 1A:
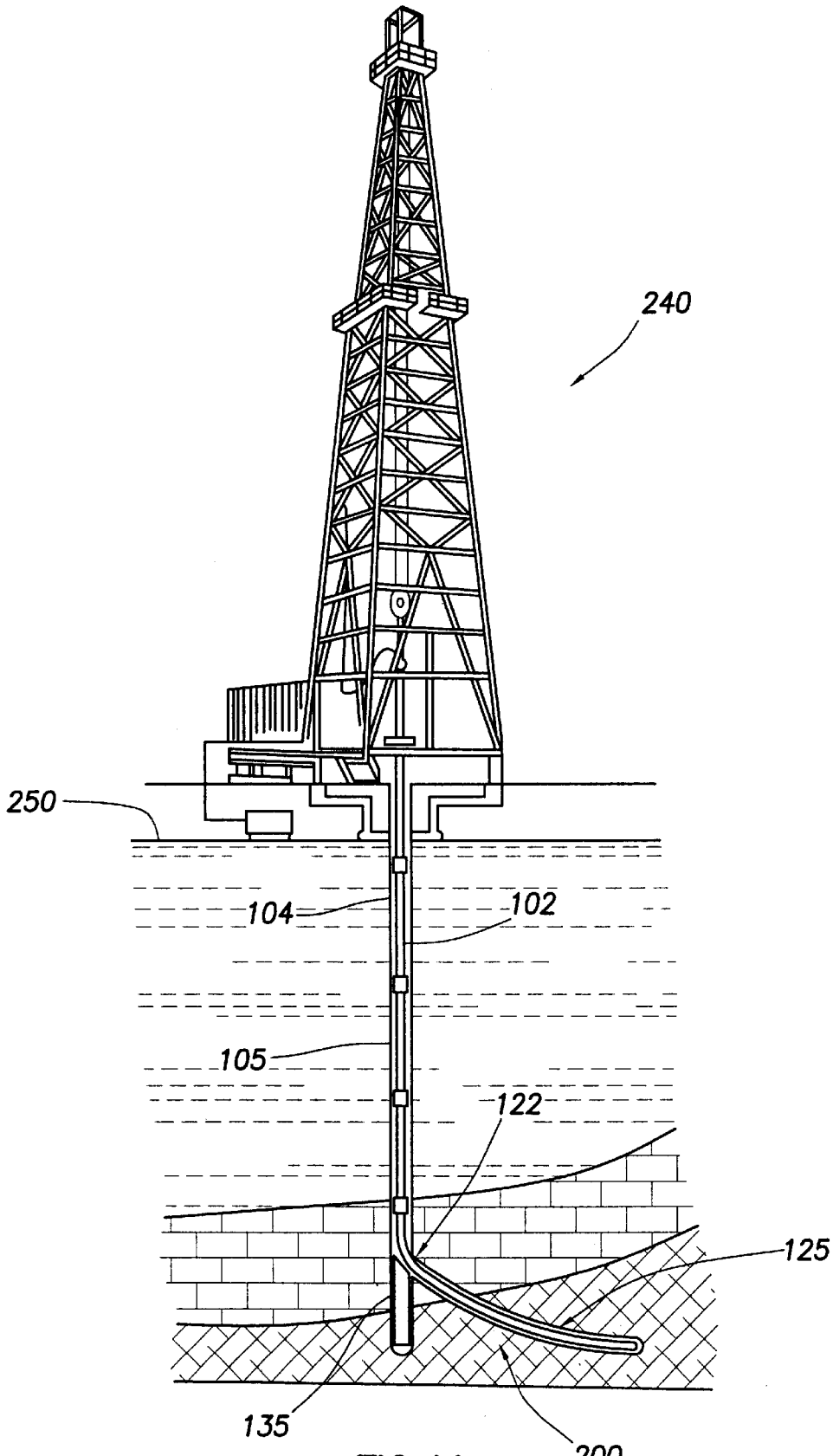
FIG. 1A is an illustration showing drilling rig 240 at the Earth's surface 250 to which are attached casing 105 and tubing 102 inside of casing 105, whipstock 135 positioned at the bottom end of casing 105 just above casing opening 122 to open hole 125.

Referring first to FIG. 1A, there is shown an illustration of a typical drilling rig 240 on the Earth's surface that can be used to insert expandable tubing 102 inside casing 105.

Figure 1B:
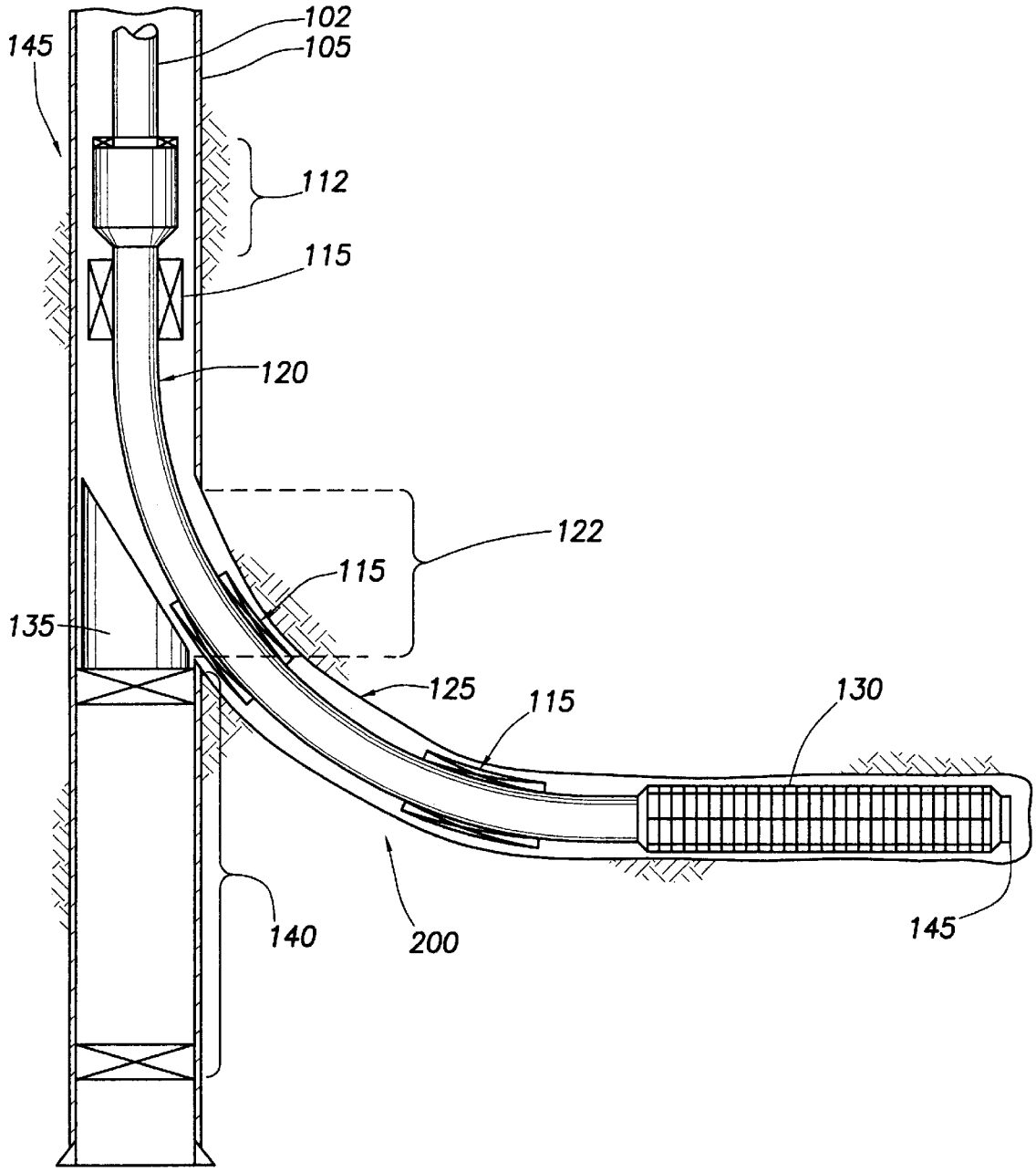
FIG. 1B is an enlarged illustration of expanding packer 200 of FIG. 1A.

Referring additionally to FIG. 1B, there is shown an illustration of the apparatus and method for using expanding packer 200 attached at its upper end to running assembly 112, and attached at its lower end to screen 130.

In the practice of the present invention, the expanding packer will comprise one or more expanding elastomeric element, which encircle the expandable tubing, with each of the one or more elastomeric elements being the same or different widths, and with the various spacings between adjacent elastomeric elements being the same or different.

Figure 2:
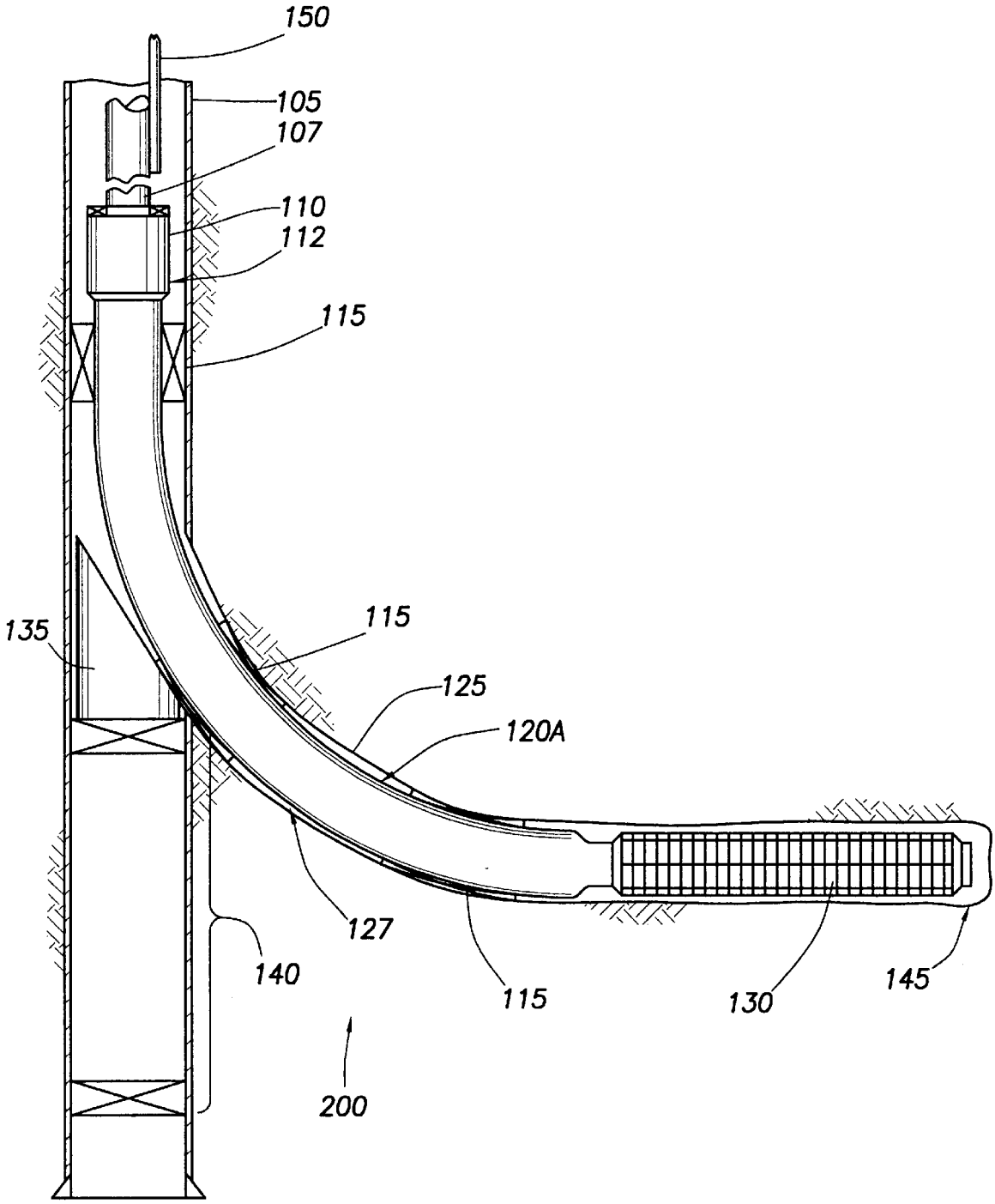
FIG. 2 is an illustration of the apparatus and methods used to produce oil or natural gas from a side tracked well that is unlined with casing. Shown is expanding packer 200 after expansion and several expanding elements 135 in contact with the walls of side tracked well 125.

For example, in the embodiment of expanding packer 200 as shown FIGS. 1 and 2, expanding packer 200 comprises three expanding elastomeric sealing elements 115 encircling expandable tubing 120. Elements 115 will serve to seal the annular space between tubing 120 and the wall of open hole 125, upon expansion of tubing 120.

While expanding packer 200 comprises elastomeric expanding sealing elements 115 illustrated as being about the same width 115B (along the length of tubing 120) it should be understood that they may be of different widths 115B. Additionally, while the spacings 115A between adjacent sealing elements 115 are shown as being about equal, it should be understood that they may be different.

The height 115C and width 115B of expandable elastomeric sealing elements 115 are selected to provide suitable sealing characteristics between tubing 120 and the wall of open hole 125. Without being limited by theory, it is believed that height 115C and width 115B will be a function of the type of material selected for element 115, the contour of open hole 125, the geology of hole 125, down hole environment, and the amount of expansion of tubing 120.

In the practice of the present invention, it is most important that, the material of element 115, width 115B, and height 115C, be selected such that element 115 remains sufficiently intact after expansion of tubing 120 to substantially form a seal in the annular space between tubing 120 and the wall of open hole 125.

Where there are two or more elements 115, they may be spaced at various intervals along the length of the packer, with the various spacings between adjacent elements 115 being the same or different. Elastomeric expanding elements 115 may be made of any suitable material, provided that the desired amount of expansion and sealing is obtained. Suitable materials may include metals, thermoplastics, thermosets, composites, and the like. Non-limiting commercial examples of suitable materials include nitrile, viton, fluorel, aflas, and teflon.

Running assembly 112 is comprised of connector 110, shown as polished bore receptacle 110, and a pig launcher 145. Positioned in casing 105 below lateral opening 122 is plug 140 which supports whipstock 135, which serves to guide and direct packer 200 through opening 122 into open hole or side tracked well 125.

The method of inserting expanding packer 200 into side tracked well 125 requires first ensuring, that the well bore fluid is conditioned, then attaching at the Earth's surface 250 a screen 130 to expanding packer 200, which in turn is attached to running assembly 112, which is then attached to the end of tubular work string 102 via the polished bore receptacle 110. The sequence of insertion begins with screen 130 down existing well casing 105, followed by expanding packer 200, followed by running assembly 112, finally followed by work string 102. In more detail, screen 130 is pushed against whipstock 135, which directs screen 130 followed by expanding packer 200 and the other attachments in sequence through opening 122 in casing 105 into side tracked well 125 and is extended to desired hole position 145. Side tracked well 125 is described as open to indicate that it has not been previously lined with casing.

Referring next to FIG. 2, there is shown an illustration of the apparatus and method of production using expanding packer 200. Once expanding packer 200 is positioned in side tracked well 125 as shown in FIG. 1B, an expansion pig 260 is launched from pig launcher 145 down the length of expanding packer 200 expanding it to press against the bare walls of side tracked well 125. Separate expanding elements 115, expanded by the expansion of packer 200,contact at intervals the walls of side tracked well 125, holding expanding packer 200 in place and restricting and preferably preventing the flow of liquids through annular spaces 127 defined between expanded tubing 120A and walls of side tracked well 125 and bounded by expanding elements 115.

An alternative method of using an expansion pig to enlarge expanding packer 200 is to position the pig in the end of expanding packer 200 adjacent to screen 130, prior to insertion downhole. Once screen 130 is positioned at desired hole position 145, the pig can be directed to move back up expanding packer 200 and away from screen 130 to expand expanding packer 200. Following that expansion, the pig can be removed from side tracked well 125.

Once packer 200 has been expanded, tubular work string 102 is removed from casing 105, production tubing 107 is then run down into well casing 105 and connected to expanding packer 200 via polished bore receptacle 110. With annular space 127 between expanded casing 120A and the wall of side tracked well 125 blocked, oil flowing into side tracked well 125 in the vicinity of screen 130 can be drawn through screen 130 up through expanding packer 200 and up production tubing 107 allowing recovery. Production tubing 107 may also be made of expandable tubing which, once expanded with a pig, will allow a greater rate of oil transport to occur in comparison to that achieved with un-expanded tubing. Also shown is an optional surface controlled sub-surface valve 150 to allow shutting the well.

Figure 3:
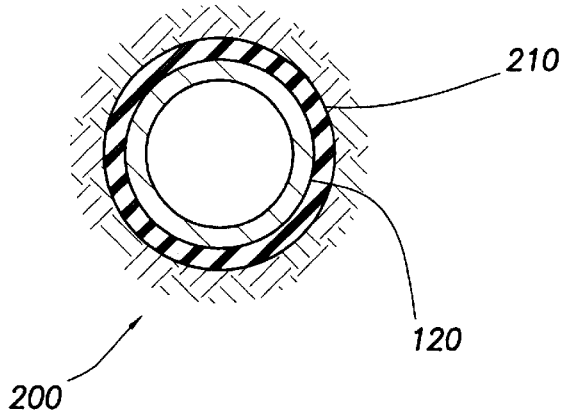
FIG. 3 is a cross section of expanding packer 200 showing expandable tubing 120 with elastomeric element 210 molded completely around expandable tubing 120.

Referring next to FIG. 3, there is shown an illustration of expanding packer 200 in cross section with the elastomeric element illustrated as a molded elastomeric coating 210 adhering to the outer surface of expandable tubing 120.

Figure 4:
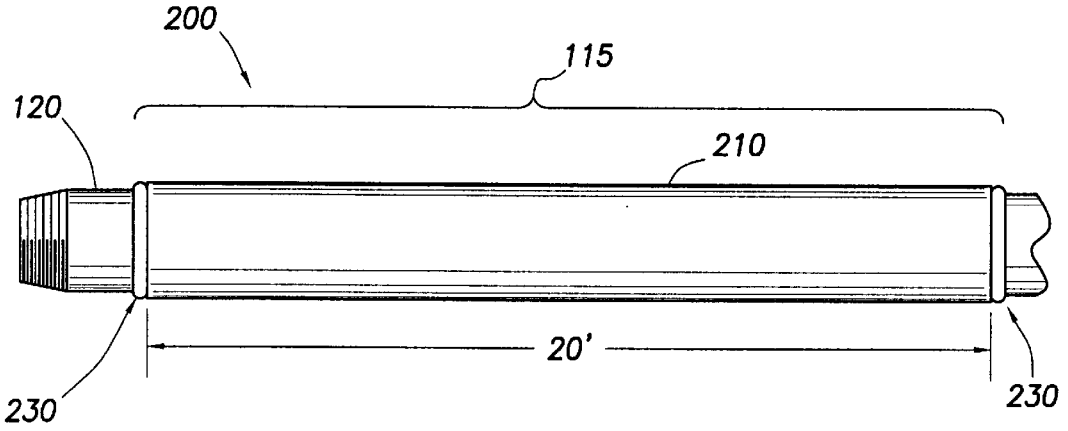
FIG. 4 is a side view of expanding packer 200 designed to be used in well applications where there is no casing lining the well.

In the practice of the present invention, one or more fasteners may be utilized to restrict the relative linear movement between the elastomeric element and the tubing. Referring next to FIG. 4, there is shown a side view illustration of expanding packer 201, another embodiment of the expanding packer of the present invention. In this embodiment, expanding packer 201 comprises only one expanding element 115, and further comprises two fasteners 230, illustrated as centralizers 230, which are ring clamps at the ends of elastomeric coating 210 that restrict it from linear movement along tubing 120 when it is expanded to the walls of the side tracked well 125. Of course, while fasteners 230 are shown affixed directly onto tubing 120 to restrict movement, it should be understood that fasteners 230 may also be positioned directly on elastomeric element 210 to bias it against tubing 120 and thereby restricting linear movement.

The methods and expanding packers 200 and 201 described above and illustrated in FIGS. 1, 2, 3, and 4 eliminate the need to run and cement an additional set of casing above or through the proposed producing formation. Expanding packers 200 and 201 for open hole side tracked wells provide an effective method for annular isolation of a producing formation by preventing movement of liquids between the outer surface of expanding packer 200 and the inner surface of side tracked well 125.

Figure 5:
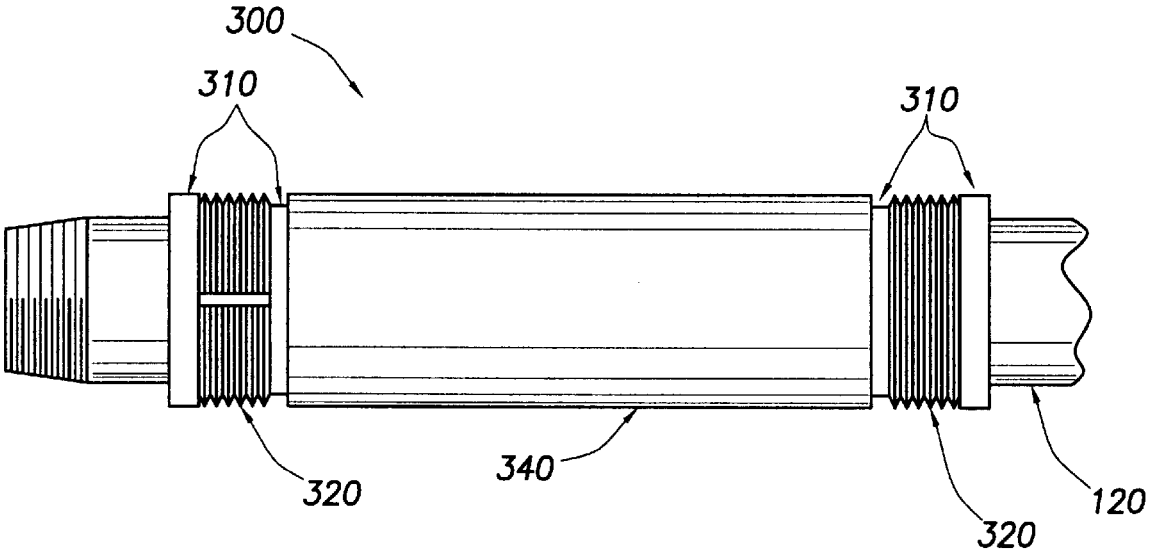
FIG. 5 is a side view of expanding packer 300 designed for use in wells that have previously been lined with casing.

Referring now to FIG. 5, there is shown an illustration of expanding packer 300 for use in cased hole applications. The method of use of this expanding packer 300 in side tracked wells is the same as that described for expanding packer 200, except that it is used in side tracked wells that have previously lined with casing. Expanding packer 300 is comprised of expandable tubing 120, encircled at intervals with elastomeric element 340, bounded on both ends by centralizer rings/expanding rings 310 which hold expanding c-ring slips 320. All of the structures of expanding packer 300 are expandable as expandable tubing 120 is expanded by the passage of an expansion pig passing through it. The methods of expanding the expanding packer 300 are the same as those for expanding the expanding packer 200, except that expanding packer 300 is positioned inside of prior casing in side tracked well 125 and elastomeric elements 340, centralizer/expanding rings 310, and expanding c-ring slips 320 serve to expand against the inner wall of casing and seal the space between expanding packer 300 and the surrounding casing of the well to prevent the flow of liquids in the annular space between expanding packer 300 and the casing of the well.

Expanding packers 200, 201 and 300 will also be useful in more conventional well completions. Expanding packers 200 and 201 for open hole applications may also be used to isolate bad casing in an existing wellbore, liner top isolation, and zonal isolation. Expanding packer,300 for cased hole applications may also be used for the above applications along with use as a production sump packer, production packer, and liner hanger, with or without sealing element applications.

Figure 6:
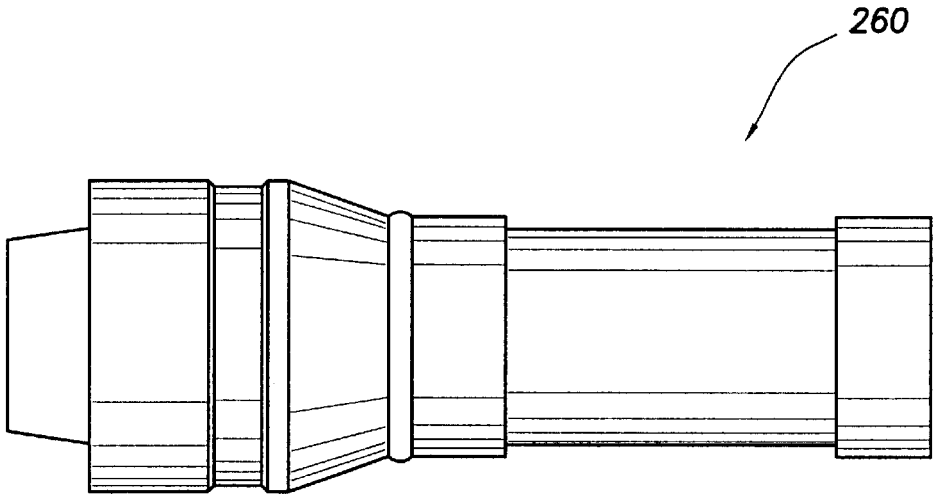
FIG. 6 is a side view of expansion pig 260 that can be passed through expandable packers 200 and 300 to expand them.

Referring now to FIG. 6, there is shown an a non-limiting example of a suitable expansion pig 260 that can be used to expand the expanding packers of the present invention by using liquid or gas pressure applied from drill rig 240 to force expansion pig 260 through the expanding packers from either their upper or lower ends.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. A packer system comprising:

(a) an expandable tubing; and (b) at least one expanding sealing element encircling said tubing, the tubing carrying at least one slip having a C-shape which expands when the tubing is expanded, and the slip having a toothed gripping surface formed on an outer periphery of the C-shape for gripping an interior surface of a wellbore.

2. The packer system of claim 1, wherein the expanding element is wrapped or molded around the tubing.

3. The packer system of claim 1, further comprising:

(c) adhesive positioned between the expanding element and the tubing.

4. The packer system of claim 1, further comprising:

(c) at least one fastener positioned to bias the expanding element against linear movement along the tubing.

5. The packer system of claim 4, wherein the at least one fastener is selected from the group consisting of centralizer rings and C-rings.

6. The packer system of claim 1, wherein the expanding element comprises a material selected from the group consisting of nitrile compounds and fluoride compounds.

7. The packer system of claim 1, further comprising:

(c) adhesive positioned between the expanding element and the tubing; and (d) at least one fastener selected from the group consisting of centralizer rings and C-rings, positioned to bias the expanding element against linear movement along the tubing;

wherein the expanding element is wrapped or molded around the tubing.

8. A work string assembly for use in a subterranean wellbore:

(a) a work string suitable for insertion into the wellbore;

(b) a pig launcher connected to the work string;

(c) an expandable tubing connected to the pig launcher; and (d) at least one expanding sealing element encircling said tubing, the tubing carrying at least one slip having a C-shape which expands when the tubing is expanded, and the slip having a toothed gripping surface formed on an outer periphery of the C-shape for gripping an interior surface of the wellbore.

9. The work string assembly of claim 8, wherein the expanding element is wrapped or molded around the tubing.

10. The work string assembly of claim 8, further comprising:

(e) adhesive positioned between the expanding element and the tubing.

11. The work string assembly of claim 8, further comprising:

(e) at least one fastener positioned to bias the expanding element against linear movement along the tubing.

12. The work string assembly of claim 11, wherein the at least one fastener is selected from the group consisting of centralizer rings and C-rings.

13. The work string assembly of claim 8, wherein the expanding element comprises a material selected from the group consisting of nitrile compounds and fluoride compounds.

14. The work string assembly of claim 8, further comprising:

(e) adhesive positioned between the expanding element and the tubing; and (f) at least one fastener selected from the group consisting of centralizer rings and C-rings, positioned to bias the expanding element against linear movement along the tubing;

wherein the expanding element is wrapped or molded around the tubing.

15. A method comprising:

(a) positioning a packer system in a subterranean well having an opening formed at an intersection between a cased first wellbore and an uncased second wellbore, wherein the packer system comprises:

(i) expandable tubing; and (ii) at least first, second and third axially spaced apart expanding sealing elements encircling said tubing, the elements expanding when the tubing is expanded;

(b) passing an expansion pig through the expandable tubing to abut the expanding elements against the well, the first expanding element sealing within the cased first wellbore, the second expanding element sealing within the uncased second wellbore, and the third expanding element sealing at least partially within the opening.

16. The method of claim 15, further comprising the step of, prior to step (a), wrapping the expanding elements around the tubing to form the packer system.

17. The method of claim 15, further comprising the step of, prior to step (a), adhering the expanding elements to the tubing to form the packer system.

18. The method of claim 15, further comprising the step of securing the expanding element on the tubing with at least one fastener selected from a group consisting of centralizer rings and C-rings.

19. The method of claim 15, further comprising the step of selecting a material for the expanding elements from a group consisting of nitrile compounds and fluoride compounds.

* * * * *